United States Patent [19]

Woodward

[11] 3,966,628

[45] June 29, 1976

[54] SOLID CLEANING COMPOSITIONS CONTAINING $C_{21}$ DICARBOXYLIC ACID

[75] Inventor: Fred E. Woodward, West Palm Beach, Fla.

[73] Assignee: Westvaco Corporation, New York, N.Y.

[22] Filed: Aug. 21, 1974

[21] Appl. No.: 499,299

[52] U.S. Cl. ..... 252/135; 252/89 R; 252/156; 252/DIG. 1

[51] Int. Cl.[2] ..... C11D 3/08

[58] Field of Search ..... 252/89, 109, 132, 135, 252/156, DIG. 1, DIG. 6, DIG. 11, DIG. 13, DIG. 14

[56] References Cited

UNITED STATES PATENTS

| | | | |
|---|---|---|---|
| 2,875,153 | 2/1959 | Dalton | 252/132 |
| 3,422,021 | 1/1969 | Roy | 252/89 X |
| 3,579,453 | 5/1971 | Dupre et al. | 252/89 |
| 3,684,723 | 8/1972 | Best et al. | 252/132 |
| 3,725,286 | 4/1973 | Pettigrew | 252/89 |
| 3,734,859 | 5/1973 | Ward | 252/108 |
| 3,769,223 | 10/1973 | Pearson et al. | 252/89 |
| 3,776,850 | 12/1973 | Pearson et al. | 252/89 |
| 3,814,692 | 6/1974 | Mostow | 252/108 |

OTHER PUBLICATIONS

Davidsohn et al., *Synthetic Detergents*, pp. 36 and 50.

*Primary Examiner*—Thomas J. Herbert, Jr.
*Assistant Examiner*—Bruce H. Hess
*Attorney, Agent, or Firm*—Dennison, Dennison, Meserole & Pollack

[57] ABSTRACT

Solid free-flowing, non-toxic cleaning compositions in the form of dry mix and powdered formulations of alkaline builders combined with from about 0.5% to about 15% of $C_{21}$ dicarboxylic acid. An alternative embodiment comprises alkaline builders combined with a mixture of salts of $C_{21}$ dicarboxylic acid in a concentration of from about 0.5% to about 28% with nonionic synthetic detergents in a 1:1 to 2:1 weight ratio of $C_{21}$ dicarboxylic acid to nonionic synthetic detergent.

5 Claims, No Drawings

SOLID CLEANING COMPOSITIONS CONTAINING $C_{21}$ DICARBOXYLIC ACID

BACKGROUND OF THE INVENTION

1. Field of the Invention

The invention relates to solid, non-toxic cleaning compositions utilizing $C_{21}$ dicarboxylic acid in the production of dry mixes and powdered formulations. The $C_{21}$ dicarboxylic acid is combined directly with either alkaline builders alone, or $C_{21}$ dicarboxylic acid in salt form is first mixed with synthetic nonionic detergents and then with the alkaline builders. The aforesaid compositions are characterized as being free-flowing and so of important value, particularly in the industrial cleaner area.

As a matter of convenience, the nonionic synthetic detergents will hereinafter be termed "nonionics."

2. The Prior Art

Cleaning compositions in dry or particulate form are presently available. These compositions include numerous and various active surfactant components as well as alkaline materials and nonionics as well as other materials described as builders.

When materials such as the popular phosphates, for example, are employed, there arises the problem of eutrophication with consequent adverse effect upon the environment.

There exists also the problem that liquid nonionics when blended into or onto dry alkaline powdered builders can only be added to a very limited percent without causing the dry mix to become tacky or to cause it to cake and be non-free-flowing.

A further problem arises in the case of available cleaning compositions in that there is lacking compatibility between the surfactant and alkaline builders and/or nonionics. This incompatibility is manifest by hydrolysis taking place in the composition and thus destroying its effectiveness and causing discoloration upon standing.

As seen in U.S. Pat. No. 3,769,223, column 3, lines 25 to 45, it is known to combine builders with various detergent actives or surfactants named in the art as anionic, cationic, nonionic, ampholytic and zwitterionic detergents. And it is a common practice to employ phosphate builders which are objectionable as being eutrophic in character, described in column 1, lines 24–45 of said patent. Accordingly, the subject invention is drawn to the use of a so-called non-phosphorus builder. This "builder" is an oxycyclopropane polycarboxylic acid such as 1-oxacyclopropane-2,3-dicarboxylic acid or salt thereof. While the "builder" component of the U.S. Pat. No. 3,769,223 detergent formulations and the apparently corresponding acid component of the present invention may both be generically described as dicarboxylic acids, the similarity ceases at this point. It is obvious from a mere comparison of the chemical structures of the $C_{21}$ dicarboxylic acid and the oxacyclopropane-dicarboxylic acid that there is no chemical resemblance whatsoever therebetween. Nor is there any resemblance in the derivation of these dicarboxylic acids.

SUMMARY OF THE INVENTION

The products of the present invention are cleaning compositions in dry or powdered form, of excellent solubility and cleaning effectiveness, being constituted of a $C_{21}$ dicarboxylic acid in combination with alkaline builders alone or $C_{21}$ dicarboxylic acid salts combined with nonionics and alkaline builders.

It is an object of the present invention to provide cleaning compositions some of which are biodegradable enjoying complete compatibility of the components thereof. These compositions are based upon a novel utilization of a hydrotropic $C_{21}$ dicarboxylic acid surfactant, in the form of either the free acid or salt thereof. A further object is to provide compositions that are highly alkaline and so particularly suitable for industrial cleaning operations. Another object is to provide such compositions in concentrated free-flowing powder form. Other objects, features and advantages of this invention will become apparent from the following detailed description.

DETAILED DESCRIPTION OF THE INVENTION

The $C_{21}$ dicarboxylic acids employed as surfactants in the preparation of the solid free-flowing compositions of the present invention are cycloaliphatic dicarboxylic acids having the structure

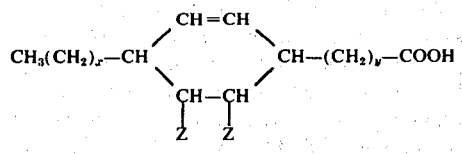

wherein $x$ and $y$ are integers from 3 to 9, $x$ and $y$ together equal 12, wherein one Z is hydrogen (H) and the other Z is a carboxylic acid group (COOH).

While the isomers wherein $x$ is 5 and $y$ is 7 form a preponderance of the acid composition, there are minor amounts of the $C_{21}$ dicarboxylic acid where the cyclohexene ring varies in position along the carbon chain. Included in the $C_{21}$ dicarboxylic composition are also minor amounts of dicarboxylic of other molecular weights.

As described in U.S. Pat. No. 3,753,968, the $C_{21}$ dicarboxylic acid is prepared by reacting linoleic acid with acrylic acid in the presence of an iodine catalyst involving a Diels-Alder or diene synthesis type of condensation reaction. This patent is incorporated by reference herein.

While tall oil is a preferred source of the linoleic acid, other suitable sources are the drying or semi-drying vegetable oils, such as soybean, linseed, tung, perilla, oticica, cottonseed, corn, sunflower and dehydrated castor oils.

The preparation of the salt form of $C_{21}$ dicarboxylic acid employed in the embodiment of this invention in novel combination with nonionics and alkaline builders is described in U.S. Pat. No. 3,734,859, incorporated by reference herein. Thus, the salts of the present invention are of various cations as inorganic sodium, potassium, lithium, and ammonium, and organic amines. Since the $C_{21}$ dicarboxylic acid has two carboxyl groups of different strength, it is easy to prepare the mono- or half-salt of the acid.

The $C_{21}$ dicarboxylic acid or salt thereof is of the following formula:

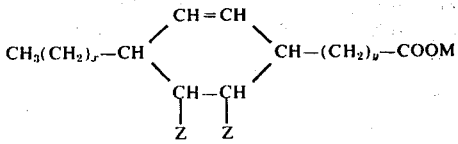

wherein $x$ and $y$ are integers from 3 to 9, $x$ and $y$ together equal 12, Z is a member of the group consisting of H and $COOM_1$, with one Z of each moiety, and M and $M_1$ are selected from the group consisting of hydrogen, sodium, potassium, lithium, ammonium and mixture thereof.

The preferred salt of the instant disclosure is the disodium salt of $C_{21}$ dicarboxylic acid (75% solids). It is admixed with a nonionic in a 1:1 to 2:1 weight ratio of $C_{21}$ dicarboxylic acid to nonionic.

The nonionics of the present invention are commercially available and variously described as nonionic surfactants, detergents, emulsifying agents or surface-active agents.

The aforesaid nonionics appear in the literature under various trade names adopted by the manufacturers thereof. This information is found, for example, in standard publications as McCutcheons "Detergents and Emulsifiers", 1972 Edition and the 8th Edition of Condensed Chemical Dictionary.

Nonionic synthetic detergents, made available on the market by Wyandotte Chemical Corp. under the trade name Pluronic, are formed by condensing ethylene oxide with an hydrophobic base formed by the condensation of propylene oxide with propylene glycol. These are describable as polyoxyalkylene derivatives of polypropylene glycols. Further description of these nonionics is found in U.S. Pat. No. 3,422,021, column 12, lines 16–32; U.S. Pat. No. 3,586,654, column 12, lines 6 et seq. and U.S. Pat. No. 3,563,901, column 3, lines 9 et seq. Those named as Pluronic L-61 or L-62 are described in detail in U.S. Pat. No. 3,650,965 as having average molecular weights of 2000 and 2500, respectively, and approximate percentages of ethylene oxide of 10 and 20, respectively.

The Igepal nonionics, made by General Aniline and Film Co., are described as alkylphenoxy poly(oxethylene) ethanols resulting from the combination of an alkylphenol with ethylene oxide. These are described as ethylene oxide ethers of alkyl phenols such as nonylphenol polyoxyethylene ether. The Igepal CO-630, a preferred non-biodegradable nonionic, is identified in U.S. Pat. No. 3,563,901, column 3(a), lines 6–8 as "nonylphenoxy poly(ethyleneoxy) ethanol."

Certain nonionic Plurafac wetting agents, made by Wyandotte Chemical Corp., are described in U.S. Pat. No. 3,563,901, column 3, (c) and (j), lines 13 and 26–27, respectively. These are described generically as straight chain primary aliphatic oxyethylated alcohols. Plurafac RA 43, a preferred nonionic of this class, is identified in the 1972 Edition of McCutcheons "Detergents and Emulsifiers."

The nonionic "Antarox BL 330" is described in McCutcheons as being an aliphatic polyether and has the terminal hydroxyl replaced with a chlorine. This nonionic is about 65% by weight ethylene oxide.

The Neodol type of nonionic, made by Shell Chemical Co., are $C_{12}$–$C_{15}$ linear primary alcohol ethoxylates. The specific Neodol 25-7 and Neodol 25-9, mols of ethylene oxide, respectively, per mol of alcohol, as described in McCutcheons 1972 Edition.

Additional information as to nonionics can further be obtained from the following U.S. Pat. Nos.:

1,970,578
2,213,477

2,577,773
2,950,255
3,526,592
3,527,608
3,769,223

The following nonionics are used in the preparation of the novel $C_{21}$ dicarboxylic-nonionic-alkaline builder cleaning compositions of the present invention:

Igepal CO-630
Pluronic L-61 or L-62
Neodol 25-7 or 25-9
Plurafac RA-43
Antarox BL 330
Triton DF-12

$C_{21}$ dicarboxylic acid being biodegradable, the compositions of the present invention are essentially biodegradable. For assurance of complete biodegradability, the Plurafac, Igepal LO-series, Triton, Neodol and Antarox nonionics are preferred.

Examples 1 to 4 relate to the $C_{21}$ dicarboxylic acid-nonionic-alkaline builder free-flowing powder embodiment of the invention cleaning compositions.

The compositions of Examples 1 to 4 are prepared by admixture of a $C_{21}$ dicarboxylic acid disodium salt (75% solids) with the particular nonionic as shown in the Examples at a 1:1 to 1:2 solids weight ratio (final mix about 85% solids). This readily pourable liquid admixture dry mixes or spray dries very readily and rapidly with solid alkaline builders in concentrations of up to about 28%, based upon the admixture of $C_{21}$ dicarboxylic acid and nonionic, to give low foam and free-flowing powders. The minimum amount of $C_{21}$ dicarboxylic acid in admixture with the nonionic is at least 0.5%.

EXAMPLE 1

An alkaline composition in powder form was made having the following formulation:

a. Disodium salt of $C_{21}$ dicarboxylic acid and liquid Triton DF-12 admixture in a ratio of 1:1 to 2:1, and
b. Sodium hydroxide beads (builder), the concentration of (a) being from about 0.5% to about 23% by weight of (b). (Triton DF-12 is a polyethoxylated straight chain alcohol modified with methyl acrylate from Rohm & Haas.)

There results a product which was stable, due to the improved compatibility of the nonionic in the system, low-foaming and free-flowing which mixed very readily and rapidly in cleaner formulations.

EXAMPLE 2

The same as Example 1 except that the concentration of the salt-nonionic admixture was from 0.5% to about 10%, and the builder was sodium metasilicate (anhydrous). The product enjoyed the advantageous properties of the product of Example 1.

EXAMPLE 3

The same as Example 1 except that the upper concentration of salt-nonionic was about 20%, and the builder was light Wyandotte soda ash and the nonionic was Antarox BL 330 described above, and having the low-foam, stable and free-flowing characteristics of the product of Example 1.

EXAMPLE 4

The same as Example 1 except that the upper concentration of the salt-nonionic was about 28%, and the builder was Flosan (Diamond Shamrock) soda ash and the nonionic was Antarox BL 330 described above. The product was of improved cleaning effect as characterized by the products of the preceding Examples.

Examples 5 to 7 relate to the embodiment of the present invention wherein $C_{21}$ dicarboxylic acid in anhydrous free acid form is sprayed or dry mixed with alkaline builders to produce cleaning compositions in powder form. The products of these Examples demonstrate the unexpected compatibility of the $C_{21}$ dicarboxylic acid with dry alkaline builders thus forming free-flowing powders that are stable as lacking discoloration on standing notwithstanding the desirable high alkaline character of the product.

EXAMPLE 5

An alkaline composition in powder form was made according to the following formulation:

a. $C_{21}$ dicarboxylic acid in anhydrous free acid form (preferably warmed to about 40°C.); and b. Sodium hydroxide flakes (builder), the concentration of (a) being from about 0.5% to about 2% of (b).

EXAMPLE 6

The same formulation as Example 5 was made except the builder was sodium metasilicate and the concentration of component (a) was up to about 10%. A solid free-flowing product resulted.

EXAMPLE 7

The same formulation as Example 5 was made except that the builder, soda ash (low density), was used and the concentration of component (a) was up to about 15%, and a solid, free-flowing dry product resulted.

While the invention has been described and illustrated herein by references to various specific materials, procedures and examples, it is understood that the invention is not restricted to the particular materials, combination of materials, and procedures selected for that purpose. Numerous variations of such details can be employed, as will be appreciated by those skilled in the art.

What is claimed is:

1. An alkaline dry mix and powdered formulation cleaning composition consisting essentially of an alkaline builder and from about 0.5% to about 15% by weight of a $C_{21}$ dicarboxylic acid having the structure

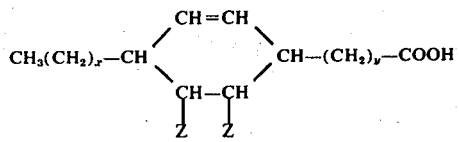

wherein $x$ and $y$ are integers from 3 to 9, $x$ and $y$ together equal 12, wherein one Z is hydrogen (H), and the other Z is a carboxylic acid group (COOH), the acid being in anhydrous free acid form.

2. A composition according to claim 1 wherein $x$ is 5 and $y$ is 7.

3. A composition according to claim 1 wherein the builder is sodium hydroxide and the concentration of the acid is between about 0.5% and about 2%.

4. A composition according to claim 1 wherein the builder is sodium metasilicate and the concentration of the acid is between about 0.5% and up to about 10%.

5. A composition according to claim 1 wherein the builder is soda ash and the concentration of the acid is from about 1% to about 15%.

* * * * *